US006042690A

United States Patent [19]

Bhattacharjee et al.

[11] Patent Number: 6,042,690

[45] **Date of Patent: *Mar. 28, 2000**

[54] METHOD FOR THE BLEACHING OF PULP IN A D2D SEQUENCE WHEREIN THE EFFLUENT CONTAINS REDUCED COLORED MATTER

[75] Inventors: Shyam S. Bhattacharjee, Monroe, N.Y.; Jean J. Renard, Mobile, Ala.

[73] Assignee: International Paper Company, Purchase, N.Y.

[ * ] Notice: This patent is subject to a terminal disclaimer.

[21] Appl. No.: 09/059,121

[22] Filed: Apr. 13, 1998

Related U.S. Application Data

[63] Continuation of application No. 07/958,576, Oct. 8, 1992, abandoned, which is a continuation of application No. 07/682,728, Apr. 8, 1991, abandoned.

[51] Int. Cl.[7] ..... D21C 9/14; D21C 9/153

[52] U.S. Cl. ..... 162/65; 162/67; 162/88; 162/89

[58] Field of Search ..... 162/65, 88, 89, 162/90, 67

[56] References Cited

U.S. PATENT DOCUMENTS

| | | | |
|---|---|---|---|
| 4,080,249 | 3/1978 | Kempf et al. | 162/57 |
| 4,216,054 | 8/1980 | Bentvelzen et al. | 162/57 |
| 4,259,149 | 3/1981 | Jaszka et al. | 162/29 |
| 4,372,812 | 2/1983 | Phillips et al. | 162/40 |
| 4,959,124 | 9/1990 | Tsai | 162/65 |

OTHER PUBLICATIONS

Leibergott, N. and van Lierop, B.; "Oxidative Bleaching—A Review"; 69th Annual Meeting, Technical Section, Canadian Pulp and Paper Association; Preprints "A"; Feb. 1–2, 1983; pp. A169–183.

Gierer, Josef; "The Chemistry of Delignification, a General Concept"; Holzforschung, 1982, pp. 43–51.

Singh, Rudra P. (Edit); "The Bleaching Of Pulp, 3rd Edition, Revised"; 1979, TAPPI Press, Atlanta, GA; pp 382 & 383.

*Primary Examiner*—Steven Alvo
*Attorney, Agent, or Firm*—Luedeka Neely & Graham P.C.

[57] ABSTRACT

A process for bleaching cellulosic pulp to a G.E. brightness of at least about 75 and a viscosity of at least about 14 wherein the effluent from the bleaching process is of reduced colored matter content and exhibits reduced COD. The process comprises DZD stages without interstage treatment of the pulp other than by an optional water wash.

11 Claims, No Drawings

METHOD FOR THE BLEACHING OF PULP IN A D2D SEQUENCE WHEREIN THE EFFLUENT CONTAINS REDUCED COLORED MATTER

This application is a continuation of application Ser. No. 07/958,576 filed Oct. 8, 1992 and now abandoned, which is a continuation of application Ser. No. 07/682,728 filed Apr. 8, 1991, now abandoned.

This invention relates to the bleaching of cellulosic pulps, and particularly kraft pulps, and to the effluent from such bleaching activities.

In the bleaching of cellulosic pulp, it is generally accepted that the use of chlorine, chlorine dioxide or a combination of these two compounds effects both chlorination and oxidation of the components of the pulp. Further, it is generally recognized that cellulosic pulps contain not only cellulose, but also many other components such as lignin, resins, pentosans, other miscellaneous organic matter, and mineral substances. Thus, when either chlorine and/or chlorine dioxide is used as the bleaching agent in the first stage of a given bleaching sequence, e.g. the well-known CEDED sequence, there occurs a large variety of chemical reactions that are in addition to the desired chlorination of lignin, the latter being that reaction which renders the lignins soluble in alkali so that they can be removed from the pulp in a subsequent stage of the bleaching process. Many of these chemical reactions result in the production of colored compounds, i.e. chromophores, that must be removed from the pulp if one is to obtain a non-colored paper product from the pulp. Oxidation reactions by the chlorine-containing bleaching agent contribute to such colored compounds, and the substitution of chlorine dioxide for the elemental chlorine has been noted to reduce the extent of such oxidation reactions. For this and other reasons, chlorine dioxide is preferred as the bleaching agent in most modern chlorine-based bleaching sequences.

Removal of the chlorinated lignins which are soluble in alkali solution is one of the primary functions of the extraction (E) stage in a cellulosic pulp bleaching sequence. Commonly, the extraction is effected at a temperature of about 60° to 70° C. and employing NaOH as the alkali. Sufficient alkali is employed to develop a pH of the pulp of about 11. Under these reaction conditions, not only are the chlorinated lignins brought into solution, but also substantial quantities of the other compounds present in the pulp also are brought into the solution. Thus, up to >80% of the total color in the pulp, >30% of the BOD (Biological Oxygen Demand), >50% of the COD (Chemical Oxygen Demand), and >14% of the total chlorides in the pulp are extracted into the solution in the extraction stage. Thus, the effluent from the extraction stage is found to contain these compounds. Still further, recent studies have found that certain of the chlorine-containing compounds (or their precursors) formed in the initial chlorination stage and/or in the subsequent extraction stage are carcinogenic, toxic or otherwise harmful.

Under present and proposed environmental regulations by various governing agencies, the presence of various chlorine-containing compounds either in the pulp or the effluent from the bleaching process must be eliminated or limited to very small quantities. Especially, the dioxin class of chlorine-containing compounds has been targeted for such reduction. Further, these same agencies have developed standards for the BOD, COD and presence of colored matter in the effluent from bleaching and other processes employed in pulp and paper mills which must be met before the effluent can be discharged to the environment. In an effort to meet such present and/or proposed guidelines, considerable effort has been and is being expended to develop bleaching processes which meet the guidelines. Unfortunately, it has been found that alternatives to the heretofore used bleaching sequences are economically expensive or in some instances may create problems with respect to the quantity or quality of the paper product produced from the pulp. For example, oxygenation has been proposed as a substitute for chlorination, but oxygen tends to degrade the viscosity of the pulp, hence the paper produced from such pulp has unacceptable strength values. Moreover, certain of the proposed modifications to conventional bleaching sequences have failed to produce the desired brightness of the pulp, which results in an unacceptable non-white paper product. Even in those instances where the brightness of the pulp appears to be at an acceptable level, it has been found that the brightness of paper produced from such pulps often reverts to lower and unacceptable brightness values upon the passage of time.

Because of the environmental demand of decreasing the amount of chlorinated organic compounds in bleached pulp and effluents, the current trend in bleaching is to reduce the chlorine charge substantially. It is predicted that chlorine consumption in the pulp and paper industry will fall rapidly, while caustic consumption will hold steady or rise. Consequently, the price of caustic soda is expected to rise rapidly. For this reason, there is a need for a caustic saving technology.

In accordance with the present invention, it has been found that pulp of good viscosity and brightness, and of lower undesirable chlorine-containing compounds (BOCl-Bound Organic Chloride) may be obtained by means of a bleaching sequence in which the initial stage comprises the use of chlorine dioxide (D) or a mixture of chlorine dioxide and chlorine and wherein this initial stage is followed by an ozonation (Z) stage and wherein the Z stage is followed by a further D stage ($D_1$), all without an alkaline extraction stage between either of such stages. Inasmuch as the prior art teaches that the use of an alkaline extraction stage following the first chlorination stage is important in achieving a bleached pulp having acceptable viscosity and brightness values, it is surprising to find that the combination of three initial stages of DZD, without an intervening alkaline extraction stage, followed by ZD, ED, or a peroxide (P) stage, will produce an acceptable pulp. As described more fully hereinafter, selection of the operating parameters associated with such initial three stages of the sequence has been found to be of importance if one is to obtain the observed desirable results. Elimination of the alkaline extraction stage provides an economic advantage associated with the elimination of the NaOH and results in reduced COD and color in the effluent from the bleaching operation. Whereas it is not fully understood, it has been further noted that the effluent from the present bleaching sequence contains less colored matter. This unexpected result provides a significant advantage relating to the use and handling of such effluent, while also contributing to the ability to comply with applicable legal and/or regulatory agency guidelines relating to the disposal of such effluent.

The present method is useful in processing both softwoods and hardwoods, and particularly kraft pulps of such woods. In the initial stage of the present bleaching process (sequence), the pulp at a pH of between about 2 and about 3 and at a consistency of between about 3% and about 10% is contacted with a quantity of chlorine dioxide (the preferred chlorination agent) (D stage) or chlorine dioxide with substitution of elemental chlorine for up to about 50% of the chlorine dioxide ($D \rightarrow C_D$ stage) in the course of carrying out such initial stage. In the preferred embodiment of such initial stage, the quantity of chlorination agent is calculated as:

$$\text{Cl factor} = \frac{\%\ Cl_2 + \%\ ClO_2 \times 2.63}{\text{Kappa No.}}$$

A chlorination factor of between about 0.1 and about 0.25 has been found to be effective in accomplishing the objectives of the present invention. Chlorination factors of less than about 0.1 fail to provide sufficient available chlorine to accomplish the desired degree of chlorination of the pulp and chlorination factors greater than about 0.25 tend to produce undesirable quantities of dioxin-type compounds, bound organic chlorides, and other objectionable compounds in the pulp. In the preferred process, elemental chlorine is used limitedly inasmuch as elemental chlorine is believed to promote the production of dioxins, among other things. For present purposes, however, when reference is made to the D stage, it is to be understood that no substantial elemental chlorine is employed. On the other hand, it is permissible in the present process to employ an initial chlorination stage in which up to about 50% elemental chlorine is substituted for chlorine dioxide, i.e. a $D \rightarrow C_D$ stage.

The pulp, in the first step, i.e. the D or the $D \rightarrow C_D$ stage, of the present bleaching process, is at a consistency of between about 3% and about 10%, based on OD pulp. Within such consistency range, it has been found that there is obtained optimum contact, hence reactivity, between the active chlorine and the cellulosic pulp. Further, at such consistencies and employing the chlorination factors referred to above, the reaction time during such initial stage need not exceed about 45 minutes at a pulp temperature of about 50° C.

pressure of about 6 psig. An outlet port at the top of the reactor permits exit of the oxygen/ozone mixture after its passage through the pulp slurry in the reactor. Analysis of the ozone concentration at the inlet and outlet ports provides a measure of the ozone (based on dry weight pulp) consumed by reaction during the residence time of the gas mixture within the reactor. The pH of the pulp at the completion of this second step is normally less than about 3.

In the third step of the present bleaching process, the pulp, after ozonation in the second step and without an intervening treatment, other than an optional water wash, at a consistency of about 10% is contacted with chlorine dioxide at a temperature of between about 60° C. and about 70° C. for about 1–3 hours (D stage). Longer reaction times (3 h) have not been found necessary. During this third step, sufficient alkali such as sodium hydroxide or sodium carbonate is added to the pulp such that the pH of the pulp at the end of the treatment period is between about 2.5 and 3.5. Within this pH range, it has been found that the effectiveness of this stage of the process is optimized.

The results of bleaching both softwood and hardwood kraft pulps in accordance with the present process are given in TABLE I. In such TABLE, there are also presented the results of the bleaching of the same pulp employing DED and DEDED bleaching sequences. From such TABLE, it will be noted that the present process (DZD, DZDED sequences) produced bleached pulps having a brightness essentially the same as the brightness of pulps produced by the conventional sequences DED, DEDED and with no significantly lesser viscosity that such conventionally bleached pulps. Further, the present process permitted elimination of up to 5.8 lb of NaOH for each lb of ozone employed, resulting in a substantial caustic savings by reason of the use of the present process.

TABLE I

Comparison of Bleaching Sequences

| | | Pulp Properties | | % Chemicals on OD Pulp | | | NaOH (lb) |
|---|---|---|---|---|---|---|---|
| Pulp | Bleaching Sequence | Brightness % GE | Viscosity cP | Total Active Chlorine | NaOH | Ozone | Replaced by 1 lb of Ozone |
| 1. Northern Hardwood | DED | 80.6 | 20.0 | 4.94 | 1.8 | — | — |
| Kraft | DZD | 79.8 | 19.1 | 4.94 | 0.65 | 0.25 | 4.6 |
| (Kappa No. 11.5) | DEDED | 88.5 | 18.8 | 5.46 | 2.30 | — | — |
| (Visc., 29.0 cP) | DZDED | 89.0 | 18.2 | 5.46 | 1.15 | 0.25 | 4.6 |
| 2. Southern Pine | DEDED | 88.5 | 20.2 | 11.0 | 3.98 | — | — |
| Kraft | DZDED | 88.6 | 18.4 | 11.0 | 1.1 | 0.75 | 3.8 |
| (Kappa No. 31.1) | DZDED | 87.5 | 20.5 | 11.0 | 1.1 | 0.5 | 5.8 |
| (Visc., 29.6 cP) | | | | | | | |
| 3. Southern Pine | DEDED | 88.9 | 20.5 | 8.07 | 2.78 | — | — |
| Kraft | DZDED | 88.7 | 19.3 | 8.07 | 1.1 | 0.75 | 2.2 |
| (Kappa No. 18) | | | | | | | |
| (Visc., 30 cp) | | | | | | | |

Following the first step, the pulp, at a consistency of between about 1% and 30% based on OD pulp, a pH of between about 2 and about 5, and without any intervening treatment other than an optional water wash, is subjected to a second stage including contacting the pulp with between about 0.1% and 1% ozone (Z stage). In one embodiment, 100% oxygen is passed through a Welsbach Ozone Generator (Model No. T408) which converts approximately 1.5 to 3.0% of the oxygen to ozone. This oxygen/ozone mixture is bubbled into the bottom of a reactor containing the pulp through an inlet port at the rate of about 2 liters/min and a Additionally, in TABLE II, there is presented the results of several examples of the bleaching of southern softwood kraft pulp of a Kappa No. of 31.4 and a viscosity of 30.1 cP, employing the present process. In such TABLE II, it is to be noted that the initial stage is identified as $D \rightarrow C_D$, but that at the noted chlorination factors compared, there are examples where there was 100% substitution of chlorine dioxide for the elemental chlorine, so that such examples represent a D stage wherein no elemental chlorine was used, i.e. a DZDED sequence. From TABLE II, it may be seen that below 50% substitution of chlorine dioxide for elemental chlorine results is a reduction in pulp brightness, and at all but one of the listed chlorination factors, the viscosity of the pulp was adversely affected by the greater amount of elemental chlorine. Further, at all tested chlorination factors, the bound organic chlorine (BOCl) on the pulp was greater than 200 ppm except in those examples where only chlorine dioxide was employed in the initial stage, with the sole exception of the example where the chlorination factor was at 0.1 which is believed to be borderline as regards the ability of the process to produce pulp of an acceptable brightness.

TABLE II

D → $C_D$ ZDED Bleaching of Southern Pine Kraft (Kappa No. 31.4; Viscosity, 30.1 cP)

| D → $C_D$ Stage | | % Total | Z Stage | Brightness | Viscosity | Pulp BOCl | Filtrate AOX |
|---|---|---|---|---|---|---|---|
| C1 Factor | % $ClO_2$ Sub | Active Chlorine | % Ozone | % GE | cP | (ppm) | (kg/ton pulp) |
| 0.25 | 20 | 7.85 | 0.25 | 87.2 | 16.0 | 248 | 6.1 |
| 0.25 | 50 | 7.85 | 0.25 | 88.8 | 16.5 | 205 | 6.0 |
| 0.25 | 100 | 7.75 | 0.25 | 88.5 | 20.0 | 128 | 2.1 |
| 0.20 | 20 | 6.28 | 0.5 | 84.0 | 17.2 | 288 | 5.8 |
| 0.20 | 50 | 6.28 | 0.5 | 86.6 | 17.1 | 268 | 4.6 |
| 0.20 | 100 | 6.28 | 0.5 | 87.1 | 18.7 | 140 | 2.6 |
| 0.15 | 20 | 4.71 | 0.75 | 83.7 | 16.2 | 268 | 4.0 |
| 0.15 | 50 | 4.71 | 0.75 | 86.6 | 15.6 | 215 | 3.3 |
| 0.15 | 100 | 4.71 | 0.75 | 87.6 | 17.5 | 105 | 1.2 |
| 0.1 | 20 | 3.14 | 1.0 | 81.8 | 14.5 | 220 | 1.3 |
| 0.1 | 50 | 3.14 | 1.0 | 84.8 | 15.1 | 173 | 1.1 |
| 0.1 | 100 | 3.14 | 1.0 | 84.9 | 17.1 | 99 | 1.1 |

% Total Active Chlorine = Kappa No. × Cl Factor = % $Cl_2$ + % $ClO_2$ × 2.63
*Conditions for DED Stages
$D_1$ Stage: 1.2% $ClO_2$, 0.8% NaOH, 70° C., 3 h
E Stage: 0.5% NaOH, 70° C., 1 h
D2 Stage: 0.3% $ClO_2$, 70° C., 3 h Further comparison of the present process with the conventional DEDED bleaching sequence is given in TABLE III. In TABLE III the DZD sequence described hereinabove was followed by either a further ZD or a D stage. As shown in the TABLE, either of these sequences produced a pulp having a brightness substantially equal to or greater than the brightness of the pulp bleached employing the conventional DEDED sequence. The viscosity of the pulps produced employing the present process with the added ZD or D stages was not materially reduced relative to the viscosity of the pulp produced by the DEDED process, and in any event such viscosity was well above the generally accepted minimum viscosity of about 14 for producing most papers from such pulps.

TABLE III

Non-alkaline Bleaching of Southern Pine Kraft Pulp (Kappa No. 31)

| | DZDZD | | | |
|---|---|---|---|---|
| | 1 | 2 | DZDD | DEDED |
| 1st Stage: | | | | |
| pH | 2.1 | 2.1 | 2.1 | 2.1 |
| % $ClO_2$ | 2.5 | 2.5 | 2.5 | 2.5 |
| 2nd Stage: | | | | |
| pH | 2.5 | 2.5 | 2.5 | 10.9 |
| % Ozone | 0.75 | 0.75 | 0.75 | — |
| % NaOH | — | — | — | 1.5 |

TABLE III-continued

Non-alkaline Bleaching of Southern Pine Kraft Pulp (Kappa No. 31)

| | DZDZD | | | |
|---|---|---|---|---|
| | 1 | 2 | DZDD | DEDED |
| 3rd Stage: | | | | |
| pH | 2.7 | 2.1 | 3.3 | 3.0 |
| % $ClO_2$ | 1.2 | 1.2 | 1.2 | 1.2 |
| % $Na_2CO_3$ | 1.0 | — | 1.0 | — |
| NaOH | — | — | — | 0.48 |
| 4th Stage: | | | | |
| pH | 2.5 | 2.5 | | 10.9 |
| % Ozone | 0.2 | 0.2 | | — |
| % NaoH | — | — | | 0.5 |
| 5th Stage: | | | | |
| pH | 2.5 | 2.5 | 2.4 | 3.5 |
| % $ClO_2$ | 0.3 | 0.3 | 0.3 | 0.3 |
| Pulp Properties: | | | | |
| Brightness, % GE | 88.1 | 85.8 | 84.8 | 87.1 |
| Reverted Brightness, % GE | 83.6 | 79.9 | 80.7 | 84.9 |
| Viscosity, cP | 18.7 | 18.3 | 19.6 | 23.0 |

Southern pine kraft pulp was bleached in accordance with the present DZD process followed by either ED, ZD or D stages, and by the conventional DEDED bleaching sequence. As shown in TABLE IV, among other things, the reverted brightness of the pulps produced in accordance with the present process (DZDED and DZDZD) is similar to the reverted brightness of the DEDED bleached pulp with the exception of the DZDD sequence. In the DZDD sequence, the reverted brightness shown is not deemed to be detrimentally low, however. Likewise, the strength properties of paper formed from the pulps bleached in accordance with the present process were found to be essentially equal to the same strength properties of paper formed from the pulp bleached in accordance with the conventional DEDED process.

From TABLE IV it is further seen that the effluent from the pulps bleached in accordance with the present process exhibited approximately 50% less colored matter. And in like manner, such pulps exhibited a COD that was about ⅔ of the COD of the conventionally bleached pulp. Both these benefits were unexpected and the reason for the same is not known with certainty. Because of the reduction in colored matter and COD of the pulps bleached using the present process, it is possible to reuse the effluent within the bleaching process for a longer time before there occurs a buildup of colored matter or COD such that the effluent must be replaced, treated and discharged. Alternatively, the effluent from the present process may be treated for discharge as a waste stream at a substantially lesser cost than the effluent from the conventional pulp bleaching process.

TABLE IV

Southern Pine Bleached Kraft Properties

| | DEDED | DZDED | DZDZD | DZDD |
|---|---|---|---|---|
| Brightness, % GE | 85.7 | 87.7 | 86.5 | 85.1 |
| Reverted Br., % GE | 83.9 | 84.8 | 83.9 | 80.6 |
| Viscosity, cP | 23.8 | 18.2 | 15.7 | 19.7 |
| TAPPI Handsheet Strength Properties (400 CSF) | | | | |
| B.L. (KM) | 9.96 | 9.46 | 9.91 | 9.63 |
| Burst Factor | 79.1 | 79.1 | 79.5 | 81.0 |
| Tear Factor | 97.3 | 91.9 | 97.1 | 94.4 |
| BOCl (ppm) | 210 | 178 | 193 | 224 |
| Effluent Properties: (kg/tp) | | | | |
| Color | 97.2 | 55.4 | 48.9 | 53.9 |
| COD | 84.3 | 60.9 | 57.0 | 54.2 |
| AOX | 1.55 | 1.70 | 1.37 | 1.55 |
| % Chemicals on OD Pulp | | | | |
| $ClO_2$ | 4.0 | 4.0 | 4.0 | 4.0 |
| $O_3$ | 0 | 0.75 | 0.95 | 0.75 |
| NaOH | 2.48 | 0 | 0 | 0 |
| $Na_2CO_3$ | | 1.0 | 1.0 | 1.0 |

As noted, the present bleaching sequence can be made completely free of alkaline extraction stage(s), thereby providing the noted savings in alkali. Such elimination of the alkaline extraction stage(s) in the bleaching sequence does not materially affect those properties of the pulp which make it acceptable in the formation of paper of a printing quality. Importantly, such elimination of the alkaline extraction stage(s) has been found to beneficially reduce the colored matter in the effluent from the bleaching process, to reduce the COD of such effluent. Further, it is possible to reduce the AOX of such effluent using the DZDZD sequence, and to reduce the BOCl of the pulp by both DZDZD and DZDED sequences.

As noted, the bleaching process of the present invention may be, and preferably is, carried out without employing a water wash (i.e. D, Z, D) of the process. Table V presents the results of bleaching softwood kraft pulp of Kappa No. 31.4 both with and without interstage water washing of the pulp. Whereas lack of such interstage water washes resulted in lower final brightness values of the pulp, such brightness values are acceptable for many uses of such pulp.

TABLE V

Three-Stage DZD Bleaching of Softwood Kraft Pulp (Kappa No. 31.4)

| | DZD Bleaching | | | |
|---|---|---|---|---|
| | With interstage Washing | Without interstage betwn. 1st D and Z Stage | Without interstage washing between Z and 2nd D Stage | |
| | 1 | 2 | 3 | 4 |
| 1st Stage: | | | | |
| Cl Factor | 0.23 | 0.23 | 0.23 | 0.23 |
| % $ClO_2$ | 2.75 | 2.75 | 2.75 | 2.75 |
| 2nd Stage: % Ozone | 0.75 | 0.75 | 0.75 | 0.75 |
| 3rd Stage: | | | | |
| % $ClO_2$ | 1.2 | 1.2 | 1.2 | 1.5 |
| % $NA_2CO_3$ | 1.2 | 1.2 | 1.2 | 1.5 |
| End pH | 3.7 | 3.5 | 2.8 | 3.0 |
| Pulp Properties: | | | | |
| Brightness, % GE | 81.3 | 75.9 | 79.7 | 84.8 |
| Viscosity | 21.2 | 21.9 | 20.9 | 21.3 |

What is claimed is:

1. A process for the bleaching of a cellulosic pulp to a target brightness of at least about G. E. 75 and a viscosity of at least about 14 cP comprising:

a first stage which includes contacting said pulp at a consistency of between about 2% and about 15% and a pH of between about 1.5 and about 3 with a chlorination agent including at least about 50% chlorine dioxide and a chlorination factor of between about 0.1 and about 0.25 and, thereafter, without an intervening treatment other than an optional water wash, a second stage subsequent to the first stage which includes contacting said pulp at a pH of about 5 or lower and a consistency of between about 1% and about 30% with ozone and, thereafter, without an intervening treatment other than an optional water wash, a third stage subsequent to the second stage which includes contacting said pulp with chlorine dioxide at a pH at the end of the stage of from about 2.5 to about 3.5, wherein the effluent from said bleaching process contains less colored matter and exhibits a lower COD than the effluent from a pulp bleaching process wherein there is employed an alkali extraction between either of said first or second stages.

2. The bleaching process of claim 1 further comprising adding in said third stage sufficient alkali to cause the pH of the pulp to be about 3 at the completion of said third stage.

3. The bleaching process of claim 1 wherein said first stage comprises a D or D→$C_D$ stage, said third stage comprises a D or D→$C_D$ stage, and including a fourth stage selected from the group consisting of an E stage followed by a D stage, a peroxide stage, a Z stage, a Z stage followed by a D stage, and a D stage followed by a further D stage.

4. The bleaching process of claim 1 in which the stages are carried out without a water wash between said first and second stages.

5. The method of claim 4 wherein the pH of the pulp during the initial 3 stage sequence is maintained in the range of from between about 2 and about 4.

6. The bleaching process of claim 1 in which the stages are carried out without a water wash between said second and third stages.

7. A method for reducing the quantity of colored matter in effluent from a pulp bleaching process which comprises an initial three stage sequence wherein the first and third bleach stages of said sequence are carried out at an acidic pH using a bleaching agent comprising chlorine dioxide and the intervening second stage is carried out at an acidic pH using a bleaching agent comprising ozone, there being no alkaline extraction between said first and second or said second and third stages and no interstage treatment of the pulp between the first and second stages or between said second and third stages other than an optional water wash.

8. The method of claim 7 further comprising a water wash of the pulp between the first and second stages.

9. The method of claim 7 further comprising a water wash of the pulp between the second and third stages.

10. The method of claim 7 further comprising an alkaline extraction stage after said third stage.

11. The method of claim 10 wherein the pH of said pulp is maintained below about 5 prior to the alkaline extraction stage.

* * * * *

UNITED STATES PATENT AND TRADEMARK OFFICE

CERTIFICATE OF CORRECTION

PATENT NO. : 6,042,690
DATED : March 28, 2000
INVENTOR(S) : Shyam S. Bhattacjarkee, et al.

It is certified that error appears in the above-identified patent and that said Letters Patent is hereby corrected as shown below:

In the Title:
After "PULP IN A", delete "D2D" and insert --DZD--.

Column 8:
Lines 51and 52, Claim 1, after "between" and before "said" delete "either of".

Signed and Sealed this

Nineteenth Day of June, 2001

*Attest:*

Nicholas P. Godici

*Attesting Officer*

NICHOLAS P. GODICI
*Acting Director of the United States Patent and Trademark Office*